US007328602B2

(12) United States Patent
Seo

(10) Patent No.: US 7,328,602 B2
(45) Date of Patent: Feb. 12, 2008

(54) PIPE EXPANDING DEVICE

(76) Inventor: Jin Mi Seo, 347-1, Mapyong-Dong, Yongin-City, Kyungki-Do 449-928 (KR)

( * ) Notice: Subject to any disclaimer, the term of this patent is extended or adjusted under 35 U.S.C. 154(b) by 0 days.

(21) Appl. No.: 11/569,749

(22) PCT Filed: Jun. 30, 2005

(86) PCT No.: PCT/KR2005/002051

§ 371 (c)(1),
(2), (4) Date: Nov. 28, 2006

(87) PCT Pub. No.: WO2006/004344

PCT Pub. Date: Jan. 12, 2006

(65) Prior Publication Data

US 2007/0261465 A1 Nov. 15, 2007

(30) Foreign Application Priority Data

Jul. 2, 2004 (KR) ..... 20-2004-0018772

(51) Int. Cl.
*B21D 39/20* (2006.01)
*B21D 41/02* (2006.01)

(52) U.S. Cl. ..... 72/393; 72/58; 72/62; 29/523

(58) Field of Classification Search ..... 72/466.2, 72/466.9, 208, 150, 393, 367.1, 370.06, 370.07, 72/370.08, 370.14, 409.17, 392, 58, 61, 62; 29/523; 166/206, 211, 214, 215
See application file for complete search history.

(56) References Cited

U.S. PATENT DOCUMENTS 4,450,612 A 5/1984 Kelly
4,580,426 A * 4/1986 Zafred ..... 72/58
4,791,796 A * 12/1988 Ford ..... 72/62
5,907,965 A * 6/1999 Krausser ..... 72/58
6,088,902 A * 7/2000 Summers ..... 29/523
7,065,995 B2 * 6/2006 Frenken ..... 72/62

FOREIGN PATENT DOCUMENTS

| | | |
|---|---|---|
| JP | 09-108759 | 4/1997 |
| KR | 2019910008740 | 6/1991 |
| KR | 1020040033788 | 4/2004 |

* cited by examiner

*Primary Examiner*—Dmitry Suhol
(74) *Attorney, Agent, or Firm*—IPLA P.A.; James E. Bame

(57) ABSTRACT

Disclosed is a pipe expanding device for expanding a thin pipe with a small diameter using elasticity and compressing and bending characteristics of a spring. Steel wires whose opposite contact sections are processed with a slope to be engaged in parallel so that contact length of both ends thereof are extended are bent and wound to form a ring spring having a single circumference with its body being partially cut off. This ring spring is used as a mold so as to expand an outer diameter of a pipe as much as a circumferential length of both ends that are widened rather than a normal circumferential diameter due to elasticity of the spring while the ring spring presses the pipe. This pipe expanding device employing the ring spring is simple and economical and allows even an unskilled person to use it easily.

2 Claims, 6 Drawing Sheets

PIPE EXPANDING DEVICE

TECHNICAL FIELD

The present invention relates to a pipe expanding device, and more particularly to a pipe expanding device for expanding a thin pipe with a small diameter using elasticity and compressing and bending characteristics of a spring, wherein steel wires whose opposite contact sections are processed with a slope to be engaged in parallel so that contact length of both ends thereof are extended are bent and wound to form a ring spring having a single circumference with its body being partially cut off, wherein this ring spring is used as a mold so as to expand an outer diameter of a pipe as much as a circumferential length of both ends that are widened rather than a normal circumferential diameter due to elasticity of the spring while the ring spring presses the pipe, whereby this pipe expanding device employing the ring spring is simple and economical and allows even an unskilled person to use it easily.

BACKGROUND ART

A generally pipe expanding device is used for expanding a front of a pipe to a desired shape so that a separate assembling member is connected thereto, when connecting pipes whose sizes are identical or different from each other.

In order to expand a thin, light and small-sized pipe made of metal material such as feeding/discharging pipes or smoke pipes, a conventional pipe expanding device is divided into two parts, and an expanding portion is formed at each part by means of bending or bulging using the pressing process, and then it is united by means of welding or soldering. In other case, one side of a pipe is cut in a length direction and spread out, and then an expanding portion is formed at the other side and then united by means of argon welding or soldering. However, such methods do not give uniform quality since the exposed expanding portion is not irregular, and deteriorates appearance since the argon-welding or soldering region is exposed as it is. In addition, workability is deteriorated and the number of processes is increased due to complicated and cumbersome individual procedures such as shaping of the expanding portion, separation of the pipe, and uniting, thereby lowering productivity and causes increase of costs.

In addition, a conventional expanding method employs pressing a pipe with a separately fabricated mold. In this case, since a circumference is expanded to form a protruded pipe expanding portion, work is troublesome and not economical due to increase of costs. Moreover, the expanding work should be conducted suitably for work conditions and its use. However, since the same expanding method as for expanding the entire pipe or for a large-caliber pipe for industrial heavy equipment is applied to a partially expanding condition or a large pipe expanding work for industrial use, which is inefficient.

DISCLOSURE OF INVENTION

The present invention is designed to solve the above problems of the prior art, and therefore it is an object of the invention to provide a simple and economical pipe expanding device, which uses elasticity of a spring for shaping and compression and bending properties for pressing when expands a thin small-caliber pipe, wherein a single-circumference ring spring having a cut portion is formed by bending and winding a high-elasticity material steel wire processed in a slant line to an angle at which its contact surfaces whose contact lengths of both ends are opposite are engaged in parallel, wherein such an end is compressed or bent along the slant to spread out both ends of the ring spring, which is used as a mold so that an outer diameter of an object is expanded as much as an increased circumference caused by spread of both ends rather than a normal circumference due to the elasticity of the spring when being pressed, wherein a long pipe may be expanded at several points to form a plurality of protrusions on one pipe.

The present invention aimed at accomplishing the above object will be described more specifically with reference to the accompanying drawings, and functions or configurations already known in the art and probably unnecessarily confusing the essential aspect of the present invention will be not described here.

The present invention provides a pipe expanding device for moving an operation rod by reciprocation of a piston using a cylinder, and partially pressing and extruding an inner circumference of a pipe by means of a pipe shaping unit connected thereto, the pipe expanding device comprising:

a cylinder (10) having a substrate (11) coupled to a fixing plate (13) by screws (12); a hollow support pipe (22) receiving a circular support frame (14) having a movable plate (15) that reciprocates an operation rod (21) by means of the cylinder (10) by fixing a piston (16) and the operation rod (21) to an inside thereof, and also receiving the operation rod (21) with a circular section and a long ring shape at one side of the circular support frame (14); a fixing member (23) having one end (23*b*) having a step around the operation rod (21) and firmly coupled to one end of the support pipe by specialized welding and the other end (23*a*) at a vertical inner end that is partially tapered so that a moving member (25) is only partially received on a slant surface and a ring-shaped spring (24) is lifted up; a single-circumference ring-shaped spring (24) fitted into an outer circumference of the operation rod (21) wherein a steel wire made of elastic material processed with a slope to an angle at which contact portions (24*a*)(24*b*) are engaged with facing to extend contact length of both ends thereof is bent and wound to divide a part of its body; and a moving member (25) having one contact end (25*a*) tapered and corresponding to the fixing member (23) and the other end at which a cut groove (25*b*) receiving a screw (26) and a screw part (21*b*) to be engaged with the operation rod (21) on an inner circumference thereof so as to form a pipe shaping unit (20), wherein the ring-shaped spring (24) is used as a mold so that, when the operation rod (21) is pulled by the cylinder (10) and the moving member (25) slides together toward the fixing member to press a coaxially fixed pipe (30) to be expanded, the spring is further spread out rather than a normal circumference due to the thickness of the spring with elasticity and also the outer circumference of the pipe (30) is locally expanded as much as the increased circumferential length and partial thickness of the spring (or, mold).

That is to say, when the moving member (25) slides to press the fixing member (23) whose inner end (23*a*) of one side is partially tapered to give a vertical surface and an inner slant surface at the same time, only a part of the moving member (25) is received close to the slant surface so that the ring-shaped spring (24) is lifted up due to pressure caused by collision with the slant surface. In addition, as the entire spring is pushed out of the circle diameter, the outer diameter of the pipe (30) is locally expanded as much as the circumferential length and a partial thickness of the spring (mold). At the slant contact portions (24*a*)(24*b*) of the ring-shaped spring (24) surface-contacted in an orthogonal direction with facing with each other, a fine gap is generated.

Reference numerals 12, 17*a*, and 17*b* denote screws, and reference numeral 18 denotes a support plate.

As a pipe expanding unit, when pressing a pipe to be expanded by moving the moving member toward the fixing member the present invention forms a steel wire made of elastic material and whose sections of extending contact portions facing with each other are processed with slopes crossing with each other, into a single-circumference ring-shaped spring whose body is partially divided, by using a mold interposed therein. Elasticity of the spring is used when pressing, and the circumference length increased rather than a circumferential length of a tapered contact portion and the thickness of the spring (mold) are also used together with the compressing and bending properties when shaping. Thus, the pipe may be expanded in an easier way with simpler structure. In addition, after the ring-shaped spring expands the pipe, it may restore its original position to an initial length (pie) due to the elastic restoring force of the spring, thereby reducing costs and gives more economic effects.

BRIEF DESCRIPTION OF THE DRAWINGS

FIG. 3 shows an operation state of the present invention, in which:

EXPLANATION OF REFERENCE NUMBERS

Figure 1:
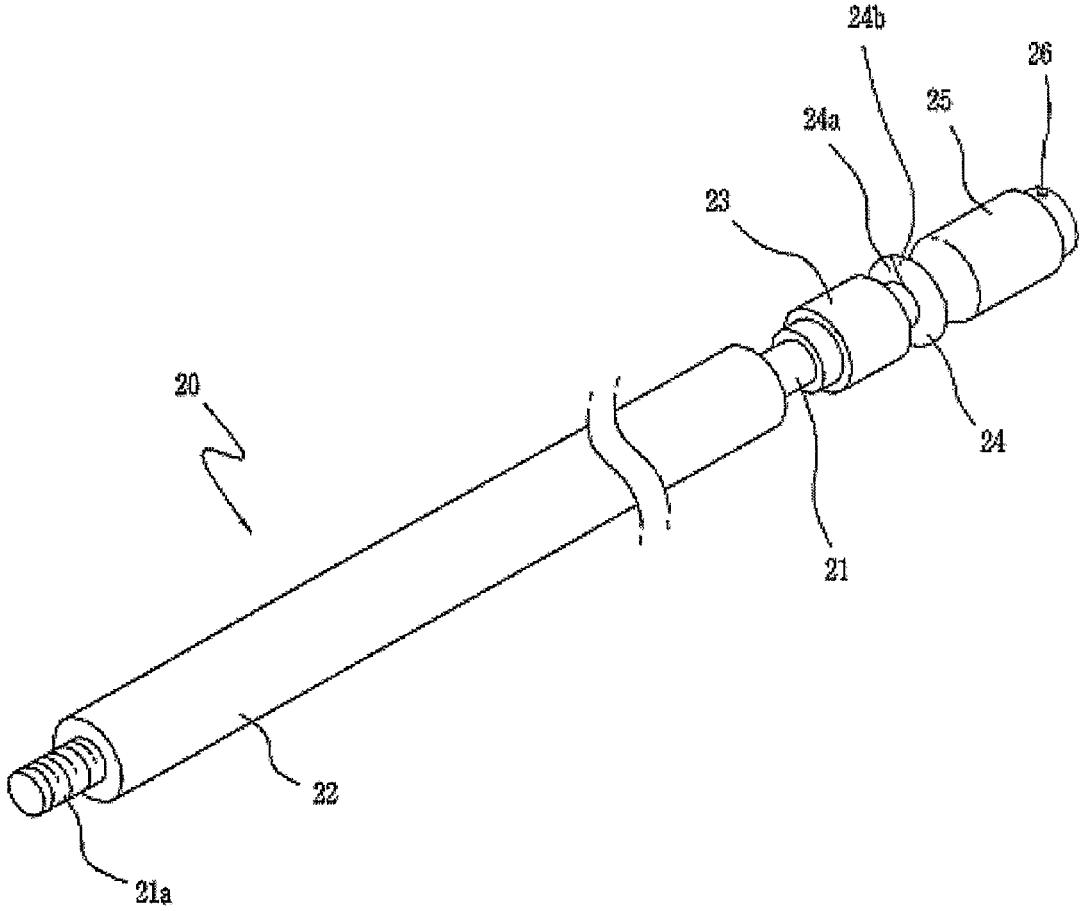
FIG. 1 is a perspective view showing the entire configuration of a pipe expanding device according to the present invention.
Figure 2:
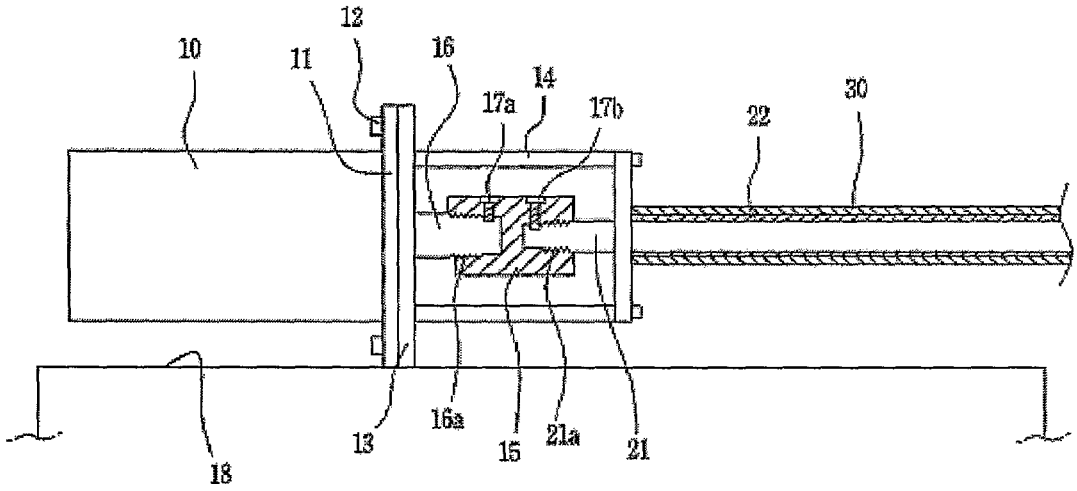
FIG. 2 shows connection between a power device and a pipe expanding device according to the present invention.
Figure 3A:
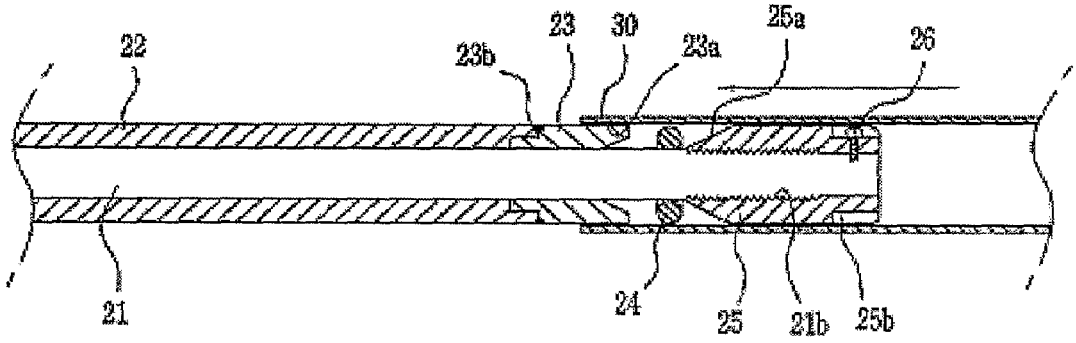
FIG. 3*a* shows that a moving member is separated from a fixing member of the pipe expanding device.
Figure 3B:
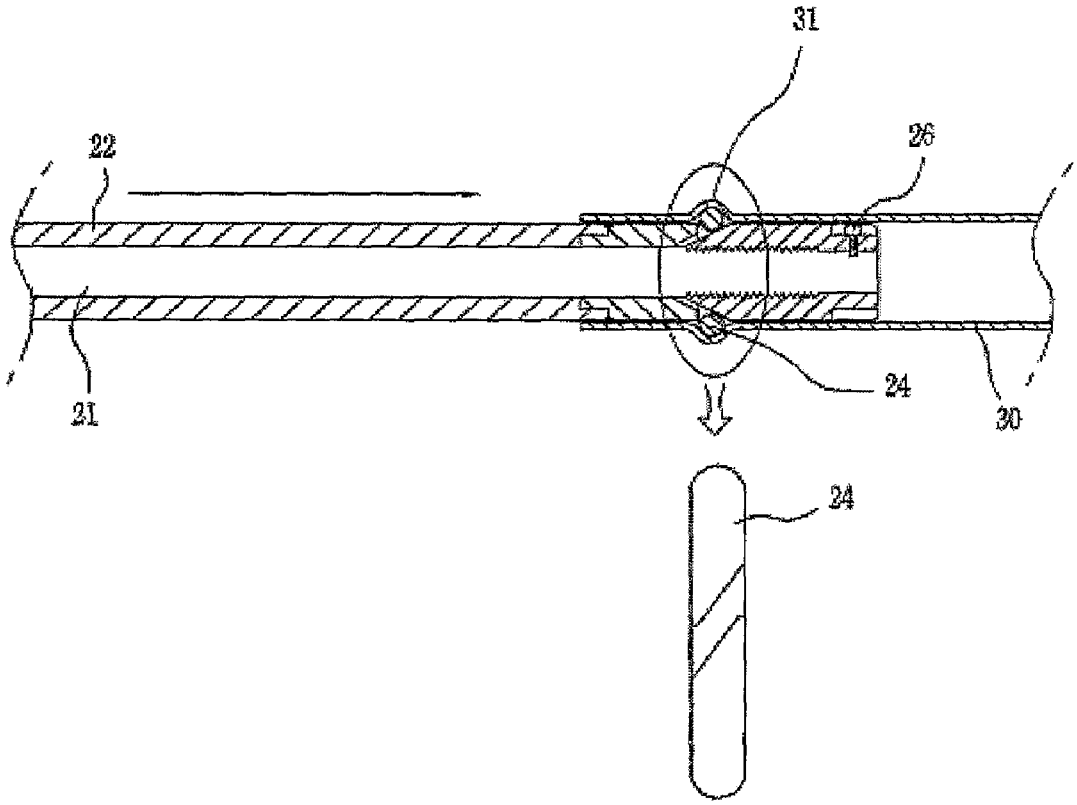
FIG. 3*b* shows that the moving member is moved to conduct the pipe expanding work according to the present invention.
Figure 4:
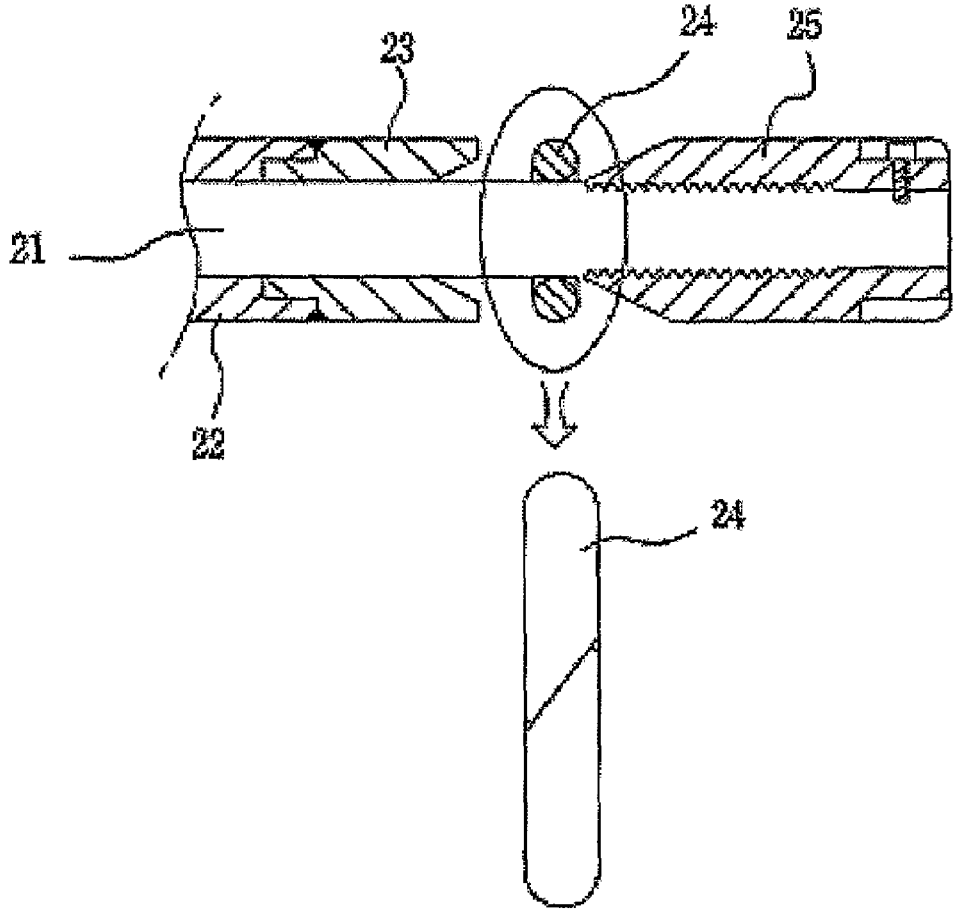
FIG. 4 is a partially expanded view showing essential parts of the pipe expanding device according to the present invention.

10: cylinder
11: substrate
12: screws
13: fixing plate
14: circular support frame
15: movable plate
16: piston
16*a*: screws
18: support
20: pipe shaping unit
21: the operation rod
21*a*,21*b*: screw part
22: support pipe
23: fixing member
23*a*: other end
23*b*: end of the fixing member
24: ring-shaped spring
24*a*, 24*b*: contact portions
25: moving member
25*a*: contact end
25*b*: cut groove
26: screw
30: non-expanded pipe
31: protrusion

BEST MODES FOR CARRYING OUT THE INVENTION

Hereinafter, preferred embodiments of the present invention will be described in detail with reference to the accompanying drawings.

As shown in the figures, a pipe expanding device of the present invention uses a cylinder 10 connected by a known hydraulic hose (not shown) as an electric power source, and the cylinder 10 is seated on a support 18 and sandwiched to a fixing plate 13 by a plurality of screws 12 to be horizontally fixed.

A piston 16 is connected to one side of the cylinder 10 by means of a movable plate 15 inside of a circular support frame 14 having an inner hollow, and an operation rod 21 having a ring rod shape is connected and fixed to the other side of the cylinder 10 with a predetermined gap by screws 17*a*, 17*b*. Thus, if the cylinder 10 is electrically operated, the piston 16 is moved, and thus the movable plate 15 connected thereto is driven to move the operation rod 21 together.

The operation rod 21 coaxially receives a support pipe 22 fixed to one side of the circular support frame 14 on its outer circumference, and also concentrically receives a non-expanded pipe 30, described later, to be overlapped. The operation rod 21 is extended inward through the circular support frame so as to get power, and screws 21*a*, 16*a* are formed at one end of the extension as coupling means so that it may be firmly screwed and fixed to the movable plate 15.

Screws 21*b* are also formed at the other end of the operation rod 21 that is coupled to a moving member 25 during the expanding work so that the operation rod 21 is screwed to the moving member 25. The moving member 25 firmly coupled as mentioned above is mutually adhered to the fixing member 23 as the operation rod 21 is pulled by means of the cylinder 10, thereby pressing a ring-shaped spring 24.

In addition, the support pipe 22 is overlapped and concentrically inserted in a length direction of the outer circumference of the operation rod 21. The support pipe 22 is coaxially fitted with other shaping members such as the fixing member 23, the moving member 25 and the ring-shaped spring 24 and has a length shorter than the operation rod 21 but suitable for ensuring sufficient moving distance. With the operation rod 21 coaxial, the fixing member 23, the ring-shaped spring 24 and the moving member 25 are subsequently connected to one side of the support pipe 22 to be capable of sliding. On the outer circumference of the shaping members configured as mentioned above, the non-expanded pipe 30 is concentrically received to overlap with each other.

A step cut in a circumferential direction is formed at one end 23*b* of the fixing member 23 so that it is coupled to one end of the support pipe 22 by specialized welding. An inner end 23*a* of the other end of the fixing member 23 is smoothly engaged with the sliding moving member 25 by means of a tapered slant surface. However, only a part of the moving member 25 is closely received onto the same tapered (or, inclined) surface. Thus, when the moving member 25 is engaged, a gap is generated to receive the ring-shaped spring, so the ring-shaped spring 24 is received into the gap by pressure of the moving member to be lifted up and protruded. As mentioned above, the inner end 23*a* of the other end is partially tapered so as to give a vertical surface and an inner slant surface together.

The moving member 25 engaged with the fixing member 23 has a contact end 25*a* at one end that is tapered to press the ring-shaped spring 24, and the other end of the moving member 25 has a cut groove 25*b* receiving a fixing screw 26 on its outer circumference, and its inner circumference is engaged with the screw 21*b* of the operation rod 21 so that the moving member 25 is firmly fixed thereto. If the ring-shaped single-circumference spring 24 is worn, the spring may be easily exchanged by releasing the vertical fixing screw 26 and the screw 21*b*.

As mentioned above, the moving member 25 and the fixing member 23 having a hollow cap shape are linearly slid in a length direction of the operation rod 21 with using the ring-shaped spring 24 as a mold and mutually adhered to each other by means of the slant surface to give pressure. The fixing member 23 and the moving member 25 are made of special steel having excellent strength not to cause abrasion or shrinkage and good durability.

The ring-shaped spring 24 (e.g., an oil temper wire) fitted into the outer circumference of the operation rod 21 and acting as a mold of a pipe expanding unit 20 as an essential part of the present invention is formed by titanium-coated steel wire made of high-elasticity material whose surface is coated with titanium to give material properties such as hardness, heat resistance, corrosion resistance, lubrication, and shape stability against restoring force so as to improve performance of the spring, which reduces abrasion even for a long time use, ensures uniform quality, improves elasticity of the spring and enhances durability. This ring-shaped spring 24 made of steel wire configures a orthogonally-engaged ring-shaped single-circumference spring 24 in which steel wire made of elastic material processed with a slope to an angle at which contact portions 24*a*, 24*b* are engaged with facing to extend contact length of both ends thereof is bent and wound to divide a part of its body.

The single-circumference ring-shaped spring 24 has compressing force and initial tension by bending and winding, giving elastic restoring force. When the ring-shaped spring 24 is used as a mold and the operation rod 21 is pulled by means of the cylinder 10, the moving member 25 slides together toward the fixing member 23 to press the non-expanded pipe 30 concentrically fixed. When an external force is applied to lift up the spring by means of elasticity of the ring-shaped spring 24, the external force is applied to the contact portions at a slant angle by means of the structure of the contact portions 24*a*, 24*b* having a slope to an angle that makes mutual engagement in parallel. Thus, the ring-shaped spring is spread out rather than a normal circumferential diameter over the entire circumferential direction, and the outer diameter of the non-expanded pipe 30 is locally expanded as much as the increased circumferential length and the partial thickness of the spring (or, mold) to form a protrusion 31 with an expanded circumference (or, pie), which is simple and easy to fabricate.

That is to say, while the outer diameter of the non-expanded pipe 30 is locally expanded to form the protrusion 31, the contact portions 24*a*, 24*b* at both ends that are a part of the ring-shaped spring 24 are orthogonal, thereby giving an expanding effect to increase a length of line. By means of this expanding effect, if force may be applied to the non-expanded pipe in a centrifugal direction on the center of the circumference of the spring uniformly to the maximum, the protrusion 31 protruded out of the outer circumference of the non-expanded pipe 30 may be expanded to substantially form a right angle.

Figure 5:
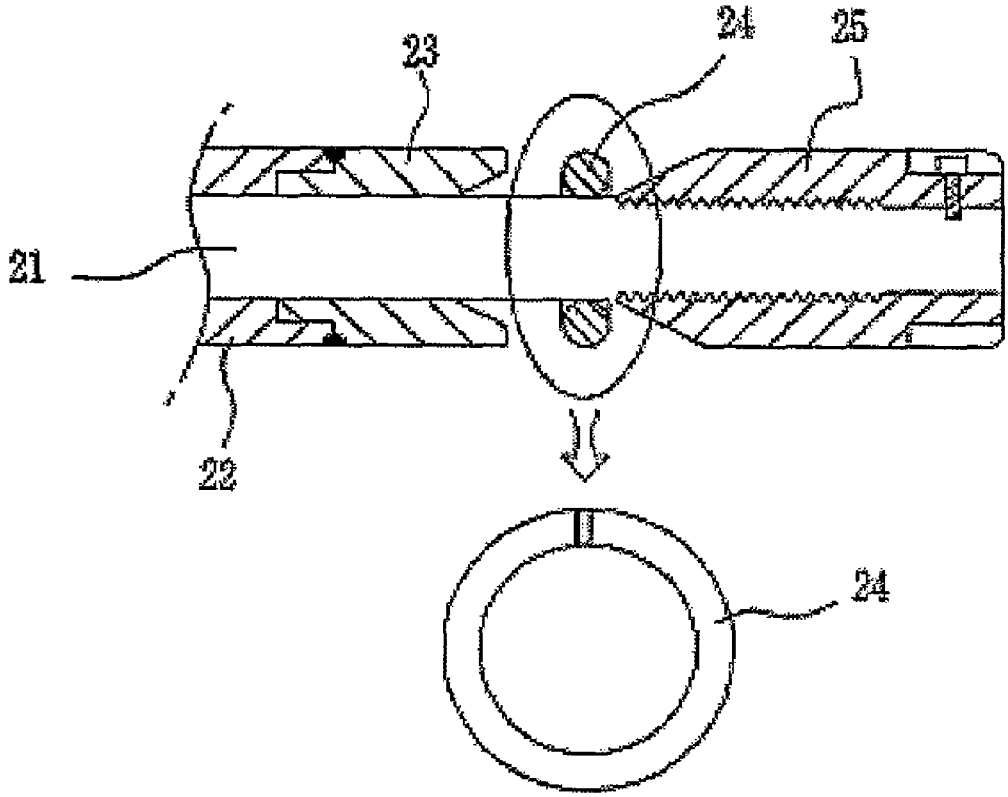
FIG. 5 shows another embodiment of the present invention.

As another embodiment of the present invention, the contact portions where the ring-shaped ring is divided may have a simple shape as shown in FIG. 5. For ensuring the ring-shaped spring 24 to keep a right position, a protruded stopper is mounted near the contact end 25*a* and a protruded stopper insert groove is prepared near the inner end 23*a*. Then, any portion not fully expanded in the primary expanding procedure may be further expanded by rotating the non-expanded pipe 30 more, so the contact portion may have various shapes.

If the moving member 25 is separated from the fixing member 23 after the expanding work of the ring-shaped spring 24, a restoring force is always remained in the ring-shaped spring 24. Thus, the pressed and expanded ring-shaped spring 24 is recovered into an original circumferential length (pie) by means of elastic restoring force, so the non-expanded pipe 30 whose expanding work is completed may be easily taken out.

The pipe expanding device of the present invention controls a size of the spring and an angle of the slope according to the diameter of the pipe, so it may be applied to pipes with various sizes. In addition, since it may expand a long pipe at several points, it is possible to form a plurality of protrusions on one pipe.

In addition, if the spring is repeatedly used as a mold as in the prevent invention, the spring may be permanently spread out to deteriorate performance. Thus, it is preferred that a hydraulic or pneumatic nippers (or, an AIR finger) is frequently used to restore the spread-out spring into an initial size, which facilitates taking out a processed non-expanded pipe or inserting a new pipe.

The present invention described above may be substituted or modified in various ways within the scope not departing from the spirit of the present invention to those skilled in the art, so it is not limited to the above embodiments.

INDUSTRIAL APPLICABILITY

The pipe expanding device of the present invention described above employs a spring with a simple shape, so it may be easily designed and fabricated with lower costs than existing molds. In addition, the device is simple and the spring may be easily exchanged, thereby simplifying the expanding work. Thus, even an unskilled person may rapidly product the device and simply and easily manipulates it. Thus, the pipe expanding device is very economic and particularly it may expand a pipe to have good appearance by partially expanding a small-caliber pipe with small thickness.

What is claimed is:

1. A pipe expanding device for moving an operation rod by reciprocation of a piston using a cylinder, and partially pressing and extruding an inner circumference of a pipe by means of a pipe shaping unit connected thereto, the pipe expanding device comprising:

a cylinder (10) having a substrate (11) coupled to a fixing plate (13) by screws (12);

a hollow support pipe (22) receiving a circular support frame (14) having a movable plate (15) that reciprocates an operation rod (21) by means of the cylinder (10) by fixing a piston (16) and the operation rod (21) to an inside thereof, and also receiving the operation rod (21) with a circular section and a long ring shape at one side of the circular support frame (14);

a fixing member (23) having one end (23*b*) having a step around the operation rod (21) and firmly coupled to one end of the support pipe by specialized welding and the other end (23*a*) at a vertical inner end that is partially tapered so that a moving member (25) is only partially received on a slant surface and a ring-shaped spring (24) is lifted up;

a single-circumference ring-shaped spring (24) fitted into an outer circumference of the operation rod (21) wherein a steel wire made of elastic material processed with a slope to an angle at which contact portions (24*a*)(24*b*) are engaged with facing to extend contact length of both ends thereof is bent and wound to divide a part of its body; and a moving member (25) having one contact end (25*a*) tapered and corresponding to the fixing member (23) and the other end at which a cut groove (25*b*) receiving a screw (26) and a screw part (21*b*) to be engaged with the operation rod (21) on an inner circumference thereof so as to form a pipe shaping unit (20).

2. The pipe expanding device according to claim 1, wherein the ring-shaped spring (24) is formed by titanium-coated steel wire made of high-elasticity material whose surface is coated with titanium to give hardness, heat resistance, corrosion resistance, lubrication, and shape stability against restoring force so as to improve performance of the spring.

* * * * *